US010906784B2

(12) United States Patent
Schilling et al.

(10) Patent No.: US 10,906,784 B2
(45) **Date of Patent: *Feb. 2, 2021**

(54) METHOD FOR CRANE ASSEMBLY

(71) Applicant: LIEBHERR-WERK BIBERACH GMBH, Biberach an der Riss (DE)

(72) Inventors: Hermann Schilling, Assmannshardt (DE); Markus Hofmeister, Bad Waldsee (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 264 days.

This patent is subject to a terminal disclaimer.

(21) Appl. No.: 16/065,094

(22) PCT Filed: Dec. 23, 2016

(86) PCT No.: PCT/EP2016/002180
§ 371 (c)(1),
(2) Date: Dec. 10, 2018

(87) PCT Pub. No.: WO2017/108194
PCT Pub. Date: Jun. 29, 2017

(65) Prior Publication Data

US 2019/0100414 A1 Apr. 4, 2019

(30) Foreign Application Priority Data

Dec. 23, 2015 (DE) ..... 10 2015 016 848

(51) Int. Cl.
*B66C 13/46* (2006.01)
*B66C 13/40* (2006.01)
*B66C 13/44* (2006.01)

(52) U.S. Cl.
CPC ..... *B66C 13/46* (2013.01); *B66C 13/40* (2013.01); *B66C 13/44* (2013.01); *B66C 2700/08* (2013.01)

(58) Field of Classification Search
CPC ..... B66C 13/46; B66C 13/40; B66C 13/44; B66C 2700/08
(Continued)

(56) References Cited

U.S. PATENT DOCUMENTS 6,744,372 B1 * 6/2004 Shaw ..... B66C 13/44 212/276
9,199,825 B2 12/2015 Dueckman
(Continued)

FOREIGN PATENT DOCUMENTS

CN 101497417 A 8/2009
CN 104555740 A 4/2015
(Continued)

OTHER PUBLICATIONS

ISA European Patent Office, International Search Report Issued in Application No. PCT/EP2016/002180, dated Apr. 25, 2017, WIPO, 6 pages.

*Primary Examiner* — Hirdepal Singh
(74) *Attorney, Agent, or Firm* — McCoy Russell LLP

(57) ABSTRACT

The invention relates to a system for central control of one or more cranes including at least one crane and at least one central control station, wherein the crane includes one or multiple image sensors observing a picked-up load, at least part of the crane surroundings and at least part of the crane structure, the crane is connected with the control station for the transmission of the image sensor data via at least one bidirectional communication link, and wherein the control station comprises at least one display element for the visual representation of the received sensor data as well as provides at least one input device for inputting control commands, and the control commands can be transmitted, via the communication link, to one or more crane actuators and/or the crane control for performing crane movements.

16 Claims, 1 Drawing Sheet

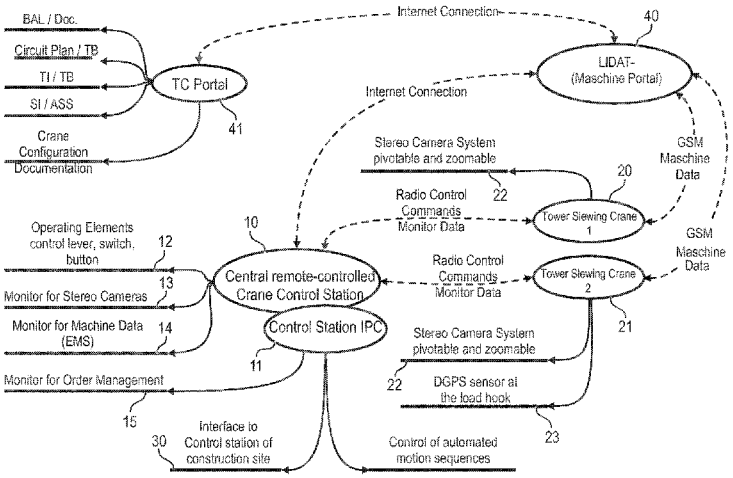

(58) Field of Classification Search
USPC ..... 340/685
See application file for complete search history.

(56) References Cited

U.S. PATENT DOCUMENTS

| | | | | |
|---|---|---|---|---|
| 2007/0235404 | A1 | 10/2007 | Catanzaro | |
| 2013/0345857 | A1 | 12/2013 | Lee et al. | |
| 2016/0031681 | A1* | 2/2016 | Delplace | B66C 13/48 345/420 |
| 2018/0170720 | A1* | 6/2018 | Mannari | B66C 13/46 |

FOREIGN PATENT DOCUMENTS

| | | | | | |
|---|---|---|---|---|---|
| CN | 104649146 | A | | 5/2015 | |
| DE | 19807989 | A1 | | 9/1999 | |
| DE | 102008021249 | A1 | | 11/2009 | |
| DE | 102009016366 | A1 | | 12/2009 | |
| EP | 1221426 | A2 | | 7/2002 | |
| EP | 1748335 | A2 | * | 1/2007 | B66C 13/46 |
| EP | 1748335 | A2 | | 1/2007 | |
| EP | 2543622 | A1 | | 1/2013 | |
| JP | 2002274779 | A | * | 9/2002 | B66C 13/40 |
| JP | 2002274779 | A | | 9/2002 | |
| JP | 2012041132 | A | | 3/2012 | |
| KR | 20040009622 | A | | 1/2004 | |
| KR | 20120117065 | A | * | 10/2012 | |
| KR | 20120117065 | A | | 10/2012 | |

* cited by examiner

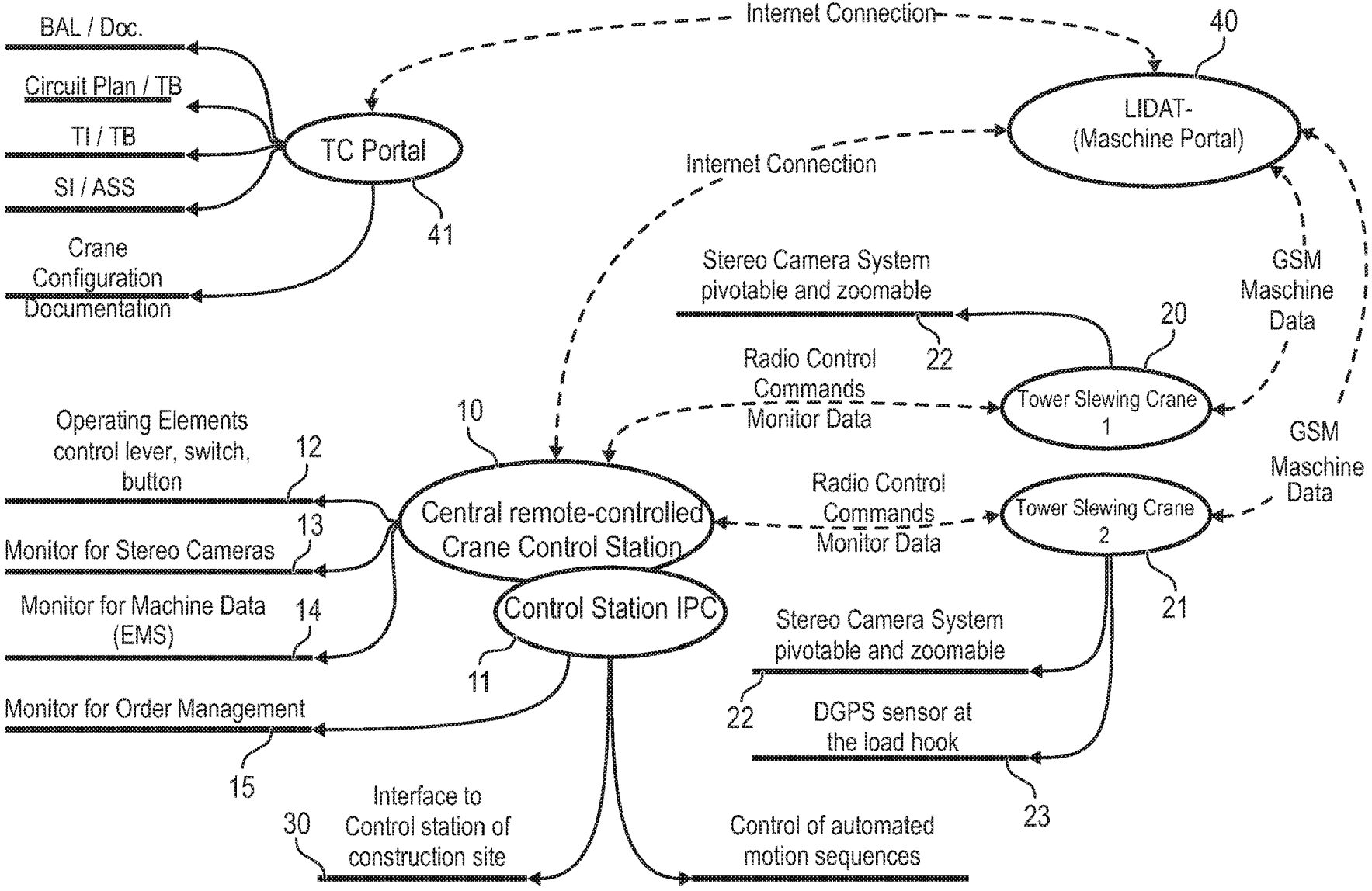
40
LIDAT-
(Maschine Portal)
GSM
Maschine
Data
GSM
Maschine
Data
20
Tower Slewing Crane
1
Tower Slewing Crane
2
21
Internet Connection
Internet Connection
Stereo Camera System
pivotable and zoomable
22
Radio Control
Commands
Monitor Data
Radio Control
Commands
Monitor Data
Stereo Camera System
pivotable and zoomable
22
DGPS sensor at
the load hook
23
Control of automated
motion sequences
Central remote-controlled
Crane Control Station
10
Control Station IPC
11
TC Portal
41
Interface to
Control station of
construction site
30
BAL / Doc.
Circuit Plan / TB
TI / TB
SI / ASS
Crane
Configuration
Documentation
Operating Elements
control lever, switch,
button
12
Monitor for Stereo Cameras
13
Monitor for Machine Data
(EMS)
14
Monitor for Order Management
15

METHOD FOR CRANE ASSEMBLY

CROSS-REFERENCE TO RELATED APPLICATIONS

The present application is a U.S. National Phase of International Patent Application Serial No. PCT/EP2016/002180, entitled "METHOD FOR CRANE ASSEMBLY," filed on Dec. 23, 2016. International Patent Application Serial No. PCT/EP2016/002180 claims priority to German Patent Application No. 10 2015 016 848.7, filed on Dec. 23, 2015. The entire contents of each of the abovementioned applications are hereby incorporated by reference in their entirety for all purposes.

TECHNICAL FIELD

The invention relates to a system for central control of one or more cranes.

BACKGROUND AND SUMMARY

At present, tower slewing cranes are operated via a radio remote control or a control station of the crane cab mounted on the crane. The radio remote control is a remote control worn by the crane operator situated on the ground. In order to remotely control the crane, the crane operator must have visual contact with the crane hook or the load at all times, which is why the crane operator must always move along with the load.

Larger top slewing cranes are usually operated via the control station in the crane cab. This control station provides the advantage that the crane operator usually has a good overview of the construction site and sufficient visual contact with the picked-up load at all times. The control station strongly binds the crane operator to the machine, since the operator will accept the exhausting and time-consuming descent from the crane only in longer interruptions.

Thus, a system is sought, which permits a novel but nevertheless reliable and safe remote control of a crane.

This object is achieved by the described crane and system. Further advantageous configurations are also described.

A system for central control of one or more cranes is proposed, wherein the system includes at least one crane and at least one central control station. The at least one crane includes one or multiple image sensors, which are configured to observe a picked-up load, at least part of the crane surroundings, as well as at least part of the crane structure. Preferably, the arrangement of the image sensors allows detecting all movable crane components, ideally of the entire crane structure. For example, image sensors are provided, which are attached to a trolley and/or a slewing platform and/or a load hook, or which can at least detect these crane components. The introduction of external screens additionally improves the crane operator's vision.

Furthermore, at least one bidirectional communication link of the crane with the central control station is provided in order to transmit the generated image sensor data to the central control station. On the side of the control station, at least one display element is provided, which allows a visual representation of the received image data. In addition, the central control station includes one or multiple input devices for entering control commands, which can be transmitted, via the established communication link, to one or more crane actuators and/or the crane control of the connected crane for the performing of crane movements.

By arranging the individual image sensors at the crane in a manner according to the invention, a sufficient field of view results for the crane operator in order to always be able to observe the required components of the crane or of the environment. There is no need for the crane operator to have direct visual contact with the crane or the surroundings, the observing of information displayed on the display element is sufficient. The positioning of the control station is thus no longer bound to limiting conditions, but instead, it is sufficient that a stable communication link with as little delay as possible can be ensured. In particular, it is thereby possible to integrate the central control station into an office container or a similar building, which is preferably centrally placed on a large construction site. The construction machines or cranes to be controlled at the large construction site can be remote-controlled from this location.

In order to enable a realistic monitoring of the crane structure, the surroundings and the load, it is particularly advantageous if the individual image sensors are formed as stereo cameras. As a result, stereoscopic visual information can be generated and transmitted to the central control station. Moreover, in this configuration, it is advantageous if one or more image elements of the central control station are formed as monitors capable of three dimensions, in order to provide the crane operator with a most plastic and realistic monitoring display. As a result, in particular spacings between crane components or objects of the surroundings can be estimated in a better way.

Furthermore, according to an advantageous embodiment, at least one crane can be equipped with one or multiple audio sensors, which detect crane noise and/or noise from the surroundings at the construction site. The crane operator can communicate with the personnel at the ground via audio sensors at the load hook. An automatic voice recognition may recognize, if requested, fixedly defined crane control commands (e.g. "emergency stop") and take corresponding measures. These audio signals can also be transmittable to the central control station via the communication link and be used there for further visual evaluation or for a simple replay through speakers.

Besides the image sensors as well as audio sensors, the crane can be equipped with further sensors, for example for the detection of external environmental impacts such as rain sensors, air sensors, temperature sensors, wind sensors, distance sensors, etc. These environmental factors are also detected through sensors and transmitted to the central control station as sensor data via the bidirectional communication link.

A monitoring means installed in the control station and/or in the control cabinet detects the received data streams of the image sensors, audio sensors as well as other sensors and processes them for being displayed at the display element.

Furthermore, it is conceivable that the sensor data of all other sensors mounted on the crane are transmitted to the central control station. This includes potential sensors at the actuators, for example, in order to detect their exact positions. In addition, data of possible pressure and force sensors as well as motion and/or distance sensors can be transmitted to the central control station, in order to detect the current operating state of the crane as completely as possible.

To be able to monitor the visual monitoring region, it can be provided that one or multiple image sensors or stereo cameras automatically focus by means of an adaptive control, or can be actuated through control commands that can be input at the control station. In particular, the image sensors or stereo cameras are mounted on the crane structure in an adjustable, ideally pivotable manner. Furthermore, adjustment or pivoting means are provided, which can be actuated by control commands that can be input at the central control station.

It is particularly expedient if control commands for actuating the image sensors or stereo cameras can be input via one or multiple foot pedals and/or foot contacts of the control station. In a specific embodiment, it is conceivable that a continuous pivoting movement and/or a continuous zooming of the image sensors or stereo cameras is made possible through an actuation of at least one foot pedal of the control station. Furthermore, a switching between different available image sensors or stereo cameras can be required. A switching between a first image sensor to a second image sensor expediently occurs through actuation of at least one foot contact of the control station.

It is also conceivable that the control station is extended with a connection interface for smart glasses. As a result, the received sensor data of the image sensors or stereo cameras can be displayed via the smart glasses for the crane operator. Actuation of the image sensors or stereo cameras can be achieved by a motion control of the glasses. for example, an adjustment or pivoting movement of individual sensors or cameras can be effected through a movement of the head of the crane operator.

Besides the display elements for the displaying of the image data, in addition at least one display element can be provided, which enables a representation of the machine data required for crane operation known from the crane cab. Moreover, supplementary information can be provided via the monitor, in addition to the customary machine data. It is particularly advantageous when the central control station comprises a communication interface to at least one external database, via which operating instructions and/or circuit plans and/or technical information and/or service information about the crane to be actuated can be retrieved and then be displayed on the display element of the central control element.

In addition, a further communication interface of the central control station to a central task management can be provided. Task-specific data from the central task management can be retrieved from or received via the central task management via this interface. A task module of the central control station serves for the evaluation of the received task, wherein the task module checks the motion sequence of the crane required for the task. Whether the crane is basically suitable for the task processing, i.e. has the required performance features to handle the task, is verified in the course of this check, for example. The task module may then mark the received tasks as feasible or non-feasible. Processed tasks are reported back. Furthermore, even disturbing influences such as heavy wind can be reported back to the master computer of the construction site.

It is also conceivable that the task module is configured in such a way that obstacles in the surroundings of the crane are discernible by means of the image sensors, and are considered for the evaluation of the feasibility of a task. As a result, besides the performance features of the crane, the surroundings of the crane are also checked in order to determine whether the task can be performed without disturbing influences of the surroundings.

It is conceivable, for example, that a task which has been marked as non-feasible is discarded by the task module, or the task is split and the subsequent task is sent to a linked crane. Furthermore, it is possible that received tasks, which have been considered to be feasible by the task module, are performed by a central crane control unit of the central control station in an at least partially automated manner. In this case, the crane control unit of the central control station directly intervenes in the control of the crane in consideration of the task, in particular, the crane control unit of the control station communicates with the crane control of the machine and/or directly with the crane actuators.

For the automated control of the crane, it is also advantageous when at least one positioning means is arranged at the crane in order to communicate the current position of the crane to the central control station. Suitable positioning means are, for example, a GPS or the DGPS receivers, which continuously or cyclically communicates the geographic crane position of the crane to the control station.

Furthermore, it is desirable that the load hook of the crane is also equipped with at least one positioning means, in order to detect the geographic hook position during crane operation and to be able to communicate it to the central control station. The positioning means of the load hook of the crane can also be configured as a GPS or DGPS receiver. Basically, the (D)GPS receiver at the load hook of the crane can also be used to detect the position of the crane and communicate it to the control station. Distance sensors assist the crane operator to precisely position the load, and help to stop crane operation on time if a collision is imminent The central control station can be equipped with a monitoring means, which evaluates the geographic position data of the hook and generates necessary control commands based thereupon, in order to be able to compensate potential load oscillations. The generated control commands are transmitted from the control station to the crane control of the crane or directly to the actuators to be controlled. As a result, an external, optional, superimposed active oscillation damping of the load realized by the central control station is realized.

Furthermore, the monitoring means can be configured to implement an external collision monitoring. Received position data of the crane and/or of the load hook can be evaluated by the monitoring means in conjunction of received data of the image sensors, in order to recognize imminent collisions of the crane with potential interfering edges at the construction site in advance. In the event of an imminent collision of the crane, the monitoring means takes influence on the crane control of the crane through the crane control unit of the control station. To that end, corresponding control signals are transmitted from the control station and to the crane for decelerating the crane movement and/or for an emergency stop of the crane operation.

Besides the system according to the invention, the present invention also relates to a crane, in particular in the form of a tower slewing crane, caterpillar crane or mobile crane, for a system according to the present invention. The crane is thus characterized by the same advantages and properties as the system according to the invention, which is why a repeated description is omitted.

At last, the invention relates to a central control station for a system according to the present invention, wherein the control station is suitable for the central control of one or more cranes. Likewise, the central control station is characterized by the same advantages and features as have already been described in relation to the system according to the invention. A repetitive description is therefore omitted.

The crane cameras can be used to monitor the construction site. The areas of application may include unauthorized access to the construction site, theft protection and recording of accidents.

A special algorithm in the IPC analyses the camera data and evaluates the situations for special events. Depending on the detected situation at the construction site, a corresponding notification is derived and communicated to a higher-level control system. In the control system, the notification can be communicated to the persons in charge of the security personnel or the proprietor via email, SMS or a social network, depending on the desired type of link.

Furthermore, camera data/images can be transmitted to the control system via a modem to evaluate the situation at the construction site.

Further advantages and properties of the invention will hereinafter be explained in greater detail by means of an exemplary embodiment shown in the only FIGURE.

BRIEF DESCRIPTION OF THE FIGURES

FIG. 1 schematically shows the individual components of the entire system and their necessary communication link amongst one another.

DETAILED DESCRIPTION

As a central element, a central remote-controlled crane control station 10 is employed, the core component of which is constituted by an industrial personal computer (IPC) 11. In its crane functions, the discrete control station 10 is nearly identical to the control station in the crane cab of a crane 20, 21 to be controlled (tower slewing crane).

The central control station 10 can be accommodated in an office container at the construction site and serves to remotely control at least one crane 20, 21. The construction of the control station 10 is composed of multiple operating elements 12, such as a control lever, switches and buttons, a 3D-capable monitor 13 for the image crane monitoring, a monitor 14 for the representation of the machine data and a monitor 14 for the monitoring of tasks.

The crane 20, 21 provides a stereo camera system 22, the individual cameras of which are pivotably mounted on the crane structure. In addition, zooming is possible by use of the camera lenses. The stereo camera system serves to observe the crane 20, 21, in particular the load, the trolley, and the slewing platform, as well as the surroundings thereof. In addition, audio sensors as well as other sensors are provided for the detection of crane movements or crane conditions. The audio sensors usually record noise from the surroundings, but operating noise caused by the crane works is also recorded. An audio sensor at the load hook serves to prevent accidents and for the communication with the rigger. The other sensors such as pressure sensors, force sensors, position sensors, sensors of the rotary mechanism, cable sensors, etc. correspond to the sensors usually employed in cranes for crane control. These sensor signals are also to be sent to the central control station. Lastly, a DGPS sensor 23 is available at the load hook, the position data of which are also transmitted to the control station 10.

A bidirectional radio connection exists between the crane 20, 21 and the control station 10, on the on hand in order to transmit the monitor or sensor data, via radio, to the control station 10, and, in the opposite direction, to send the crane control commands generated in the control station 10 to the addressed crane 20, 21. These includes control signals to actuate actuators, but also signals that serve for the configuration and orientation of the above-mentioned sensors 22.

The surroundings of the crane 20, 21 is displayed on the 3D-capable monitor 13 of the control station 10. In this region, the view is directed on the load, the construction site and the crane 20, 21. In addition, crane movements, audio signals and environmental factors are evaluated and illustrated by a monitoring means of the control station 10. The industrial personal computer (IPC) 11 mounted in the control station 10 detects the data streams of the cameras 22, crane and sensors 29 including environmental sensors, audio, position and pressure. Special algorithms process the camera data for the representation on the 3D-capable monitor 13. The sensor data is also detected, processed and displayed as superimposed images or miniature images on the monitor 13. External or integrated speakers of the monitor 13 replay the audio signals of the crane 20, 21 at the control station. Several input and display devices 31 may be incorporated into the IPC 11 to display data and receive commands. The input and display devices 31 may include devices such as smart glasses.

The crane operator can, from the control station 10, pivot the stereo cameras 22 in all directions and zoom-in the images correspondingly. The auto-focus function of the cameras 22 supports him or her in doing so. The camera functions are controlled through an adaptive control integrated on the control station and/or foot pedals 12 and foot contacts 12. The foot pedals 12 allow continuously pivoting and zooming the cameras 22. The foot contacts serve to switch the cameras 22 between trolley, slewing platform and load hook.

Thus, the crane operator is capable to correctly grasp the situation at the construction site and to very precisely control the crane movements resulting therefrom.

Optionally, smart glasses may also be used, the pivotable stereo cameras controllable by moving the head then.

The crane monitor (EMS) 14 provides the crane operator with all customary information and functions also for the control and operation that are also displayed on their monitor in the crane cab. Since the size of the monitor 14 is no longer restricted now, larger monitors 14 can be used. Thus, crane-specific documents, which are linked with the higher-level LIDAT system 40, can be displayed. Crane-specific documents are operating instructions, circuit plans, technical information and service information. This data can be retrieved, as required, from a TC portal 41 via an established internet connection of the control platform 10 indirectly via the LIDAT machine portal 40.

Furthermore, the system includes an automated task management. A central construction control station 30 transmits the transport tasks, including GPS target coordinates of the construction site, to the task management of the control station 10. In the IPC 11, an evaluation module with a special algorithm is provided, which computes and checks the motion sequence of the task and provides a partially automated sequence to the crane operator before the processing of the task (autopilot). In the event that the task can not be processed (e.g. if the load or range is exceeded), the task is marked as non-feasible. Due to the fact that the crane cameras 22 can also detect obstacles in conjunction with the collision monitoring means of the control station 10, a fully-automated motion sequence is also possible. To that end, the crane control unit of the control station 10 generates the required control commands, which are then transmitted to the respective crane.

As a result, a crane call function can also be implemented, if the crane 20, 21 is equipped with an installed DGPS receiver 23 via radio panel. Presumably, large construction sites will first be virtually simulated in the future. The motion sequences of a task can be virtually verified via a real or likewise virtual control station (WebService) in the IPC. The required crane data such as load, radius or reach, etc., can be obtained either directly from the crane or via a link to the Liebherr portal "LIDAT" 40 from the crane configurator.

In addition, the GPS coordinates of the load hook can be corrected by means of a correction signal in the IPC 11. The computed coordinates are very precise and can thus be used to control oscillation-damping crane movements, which are generated by the crane control unit of the control station 10 and transmitted to the respective crane 20, 21. Differential GPS means that the normal GPS signal is corrected by a correction signal to form a very precise DGPS signal.

In the IPC 11, by the collision monitoring means, the DGPS coordinates of the load hook are corrected together with other interfering movements detected by the cameras and, if required, safe measures will be taken. In critical areas, the speed of the crane movements is reduced and, in the case of emergency, before a collision occurs, the crane is switched-off with an emergency stop signal.

The invention claimed is:

1. A system for central control of one or more cranes including, at least one crane and at least one central control station, wherein the crane includes one or more image sensors for observing a picked-up load, at least part of the crane surroundings and at least part of the crane structure, the crane is connected to the control station via at least one bidirectional communication link for the transmission of the image sensor data, wherein the control station comprises:

at least one display element for the visual representation of the received sensor data, at least one input device for inputting control commands, an interface for receiving task-specific data from a central task manager, and a task module checks a required crane motion sequence for a received task to determine feasibility of the task, and the control commands are transmitted via the communication link to one or more crane actuators and/or the crane control for performing crane movements.

2. The system according to claim 1, wherein the one or more image sensors are stereo cameras and the display element is at least 3D-capable.

3. The system according to claim 1, wherein the crane comprises one or more audio sensors for the detection of noise of the crane and/or of the surroundings and/or environmental sensors for the detection of environmental influences, wherein this sensor data can be forwarded to the central control station and the control station comprises one or more audio speakers for the replay of received audio signals.

4. The system according to claim 1, wherein signals of one or more of pressure sensors and position sensors for the detection of the position of crane components or crane actuators, are receivable via the control station, and the control station monitors and evaluates the sensor data of the crane movements.

5. The system according to claim 1, wherein the image sensors or stereo cameras are actuated by control commands input at the control station, the image sensors or the stereo cameras are mounted on the crane in an adjustable or pivotable manner, wherein the adjustment or pivoting movement is performed by a control command.

6. The system according to claim 5, wherein the control commands for actuating the image sensors/stereo cameras are input via one or more foot pedals and/or foot contacts of the control station, wherein a continuous pivoting movement and/or a zooming of the image sensors/stereo cameras is effected by actuating at least one foot pedal of the control station and/or a switching between available image sensors/stereo cameras of the crane by actuating at least one foot contact of the control station.

7. The system according to claim 1, wherein the control station comprises a connection interface for smart glasses, wherein the displaying of the sensor data of the image sensors/stereo cameras is effected via the smart glasses, and the image sensors/stereo cameras can be actuated, adjusted or pivoted, via movements of the glasses.

8. The system according to claim 1, wherein at least one further display element is provided to display machine data or sensor data and/or operating instructions and/or circuit plans and/or technical and/or service information.

9. The system according to claim 1, wherein the task module considers discernable obstacles for the evaluation of the feasibility of a task.

10. The system according to claim 1, wherein the control station includes a crane control unit, which transmits controls signals to the crane upon a positive evaluation of the received task, in order to perform at least a part of the motion sequences of the crane in an automated manner.

11. The system according to claim 1, wherein the crane includes at least one GPS or DGPS receiver, and a geographical crane position can be communicated to the control station.

12. The system according to claim 1, wherein the crane load hook is equipped with at least one GPS or DGPS receiver, and a geographical hook position is communicated to the control station, wherein the crane control unit of the control station generates necessary crane commands based on the transmitted position of the load hook and transmits it to the crane, in order to compensate potential load oscillations.

13. The system according to claim 1, wherein the control station evaluates the received position data of the crane and/or the load hook and recognizes potential collisions of the crane with interfering edges in consideration of the received data of the image sensors, wherein, if a collision is imminent a control signal is transmittable from the crane control unit of the control station to the crane to decelerate the crane movements and/or for an emergency stop of the crane operation.

14. A crane including, at least one central control station, an interface for receiving task-specific data from a central task manager, a task module checks a required crane motion sequence for a received task to determine feasibility of the task, image sensors for observing a picked-up load, at least part of the crane surroundings and at least part of the crane structure, at least one bidirectional communication link connecting the crane to the control station via for the transmission of the image sensor data, at least one display element of the control station for the visual representation of the received sensor data, at least one input device for inputting control commands, and the control commands are transmitted via the communication link to one or more crane actuators and the crane control for performing crane movements.

15. A central control station for the central control of one or more crane, comprising:

stereo image sensors for observing a picked-up load, crane surroundings and an entire crane structure, at least one display element of the control station displaying received sensor data and receiving input control commands, and at least one bidirectional communication link connecting the crane to the control station transmitting the image sensor data and control commands, the control commands transmitted to one or more crane actuators and the crane control for performing crane movements, an interface for receiving task-specific data from a central task manager, and a task module checks a required crane motion sequence for a received task to determine feasibility of the task.

16. The central control station according to claim 15, wherein the central control station comprises an interface for the monitoring of the construction site.

* * * * *